US005644813A

United States Patent [19]

Puskas

[11] Patent Number: 5,644,813

[45] Date of Patent: Jul. 8, 1997

[54] DISPOSABLE OVERSHOE MOP

[76] Inventor: Paula Puskas, 645 Larkfield Rd., East Northport, N.Y. 11731

[21] Appl. No.: 585,375

[22] Filed: Jan. 16, 1996

[51] Int. Cl.[6] ..... A47L 13/20; A47L 13/282

[52] U.S. Cl. ..... 15/227; 36/59 C

[58] Field of Search ..... 15/227; 36/7.1 R, 36/7.3, 7.4, 7.7, 59 R, 59 C, 113

[56] References Cited

U.S. PATENT DOCUMENTS

| | | | |
|---|---|---|---|
| 1,136,150 | 4/1915 | McGrath | 15/227 |
| 2,571,606 | 10/1951 | Peterson | 15/227 |
| 2,738,533 | 3/1956 | Peterson | 15/227 |
| 2,742,717 | 4/1956 | Murray | 36/59 R |
| 2,784,436 | 3/1957 | Peterson | 15/227 |
| 3,110,971 | 11/1963 | Chang | 36/59 C |
| 3,362,775 | 1/1968 | Muecke | 15/227 |
| 3,526,014 | 9/1970 | Edwards | 15/227 |
| 3,699,672 | 10/1972 | Sims | 15/227 |
| 4,217,704 | 8/1980 | Whitaker | 36/59 R |
| 4,489,510 | 12/1984 | Williams | 36/59 C |
| 4,598,985 | 7/1986 | Joe et al. | 36/7.7 |
| 4,811,444 | 3/1989 | Hamblin | 15/104.002 |

*Primary Examiner*—Mark Spisich
*Attorney, Agent, or Firm*—Michael I. Kroll

[57] ABSTRACT

A disposable overshoe mop (10) comprising a structure (12), for covering a shoe (14) or foot worn by a person (16), so as to protect the shoe (14) or foot from water and dirt. A component (18) is affixed to the bottom of the covering structure (12), for cleaning a floor (20).

1 Claim, 2 Drawing Sheets

DISPOSABLE OVERSHOE MOP

BACKGROUND OF THE INVENTION

The instant invention is the subject matter of Disclosure Document No.: 387779, filed in the PTO on Jun. 12, 1995, and it is respectfully requested that this document be retained beyond the two-year period so that it may be relied upon as evidence of conception of the invention during the prosecution phase of this application, should the need arise.

FIELD OF THE INVENTION

The instant invention relates generally to foot floor cleaning devices and more specifically it relates to a disposable overshoe mop.

DESCRIPTION OF THE PRIOR ART

Numerous foot floor cleaning devices have been provided in prior art. For example, U.S. Pat. No. 2,571,606 to Peterson; U.S. Pat. No. 2,738,533 to Peterson, U.S. Pat. No. 3,526,014 to Edwards and U.S. Pat. No. 4,811,444 to Hamblin all are illustrative of such prior art. While these units may be suitable for the particular purpose to which they address, they would not be as suitable for the purposes of the present invention as heretofore described.

PETERSON, ESTHER

FOOT MOP

U.S. Pat. No. 2,571,606

An article for the purpose described, comprising a bottom wall flexible throughout. A collection of mopping instrumentalities are secured to and are dependent from the underside of the bottom wall. A stall for the fore part of a foot is partially provided by the bottom wall and by an added piece of flexible material secured to the bottom wall at the top and front thereof. The bottom wall is formed of superimposed layers. The top layer is attached to the piece of flexible material. The bottom layer has the mopping instrumentalities secured thereto. A means is for releasably securing the layers together.

PETERSON, ESTHER

FLOOR POLISHING MOP MEANS

U.S. Pat. No. 2,738,533

A polishing device comprising a bottom wall. An upper curved wall overlies the bottom wall and is secured at its edges to the periphery of the bottom wall and has an aperture designed to receive the foot of a person. A second wall is equal in size to and underlies the bottom wall. The second wall has banks of cloth strands secured thereto to clean the floor. Tape members are stitched around the outer peripheries of the bottom and second walls. Cooperating fastener means are secured around the tape members to releasably secure the second wall and bottom wall together.

EDWARDS, LESTER

FOOT FLOOR-SCOURING ATTACHMENT

U.S. Pat. No. 3,526,014

A floor scouring attachment for the foot of a custodian or the like is described. The attachment comprises a generally planar sole pad formed of two planar layers of the scouring material. An elastic vamp portion is secured to the sole pad between the two layers and extends between opposite side edges thereof, to form an elastic receptacle for receiving the foot of a user. An elastic heel band is secured to the vamp portion and extends rearwardly therefrom to encircle the heel of a user's foot and maintains the vamp portion and sole pad on the user's foot.

HAMBLIN, CHARLES R.

DOUBLE-SIDED ADHESIVE CLEANING APPARATUS

U.S. Pat. No. 4,811,444

A double-sided adhesive cleaning apparatus to be worn on the sole of a shoe to pick up debris from the surface of a floor. The apparatus includes an elongated adhesive strip member having upper and lower adhesive coated surfaces. The upper adhesive coated surface attached to the sole of a users shoe and the lower adhesive coated surface accumulates debris.

SUMMARY OF THE INVENTION

A primary object of the present invention is to provide a disposable overshoe mop that will overcome the shortcomings of the prior art devices.

Another object is to provide a overshoe mop that can be used to clean a floor without leaving marks or prints upon the floor.

An additional object is to provide a overshoe mop that will help dry a wet floor, while protecting the shoe or foot and will also prevent slippage upon the floor.

A further object is to provide a disposable overshoe mop that is simple and easy to use.

A still further object is to provide a disposable overshoe mop that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
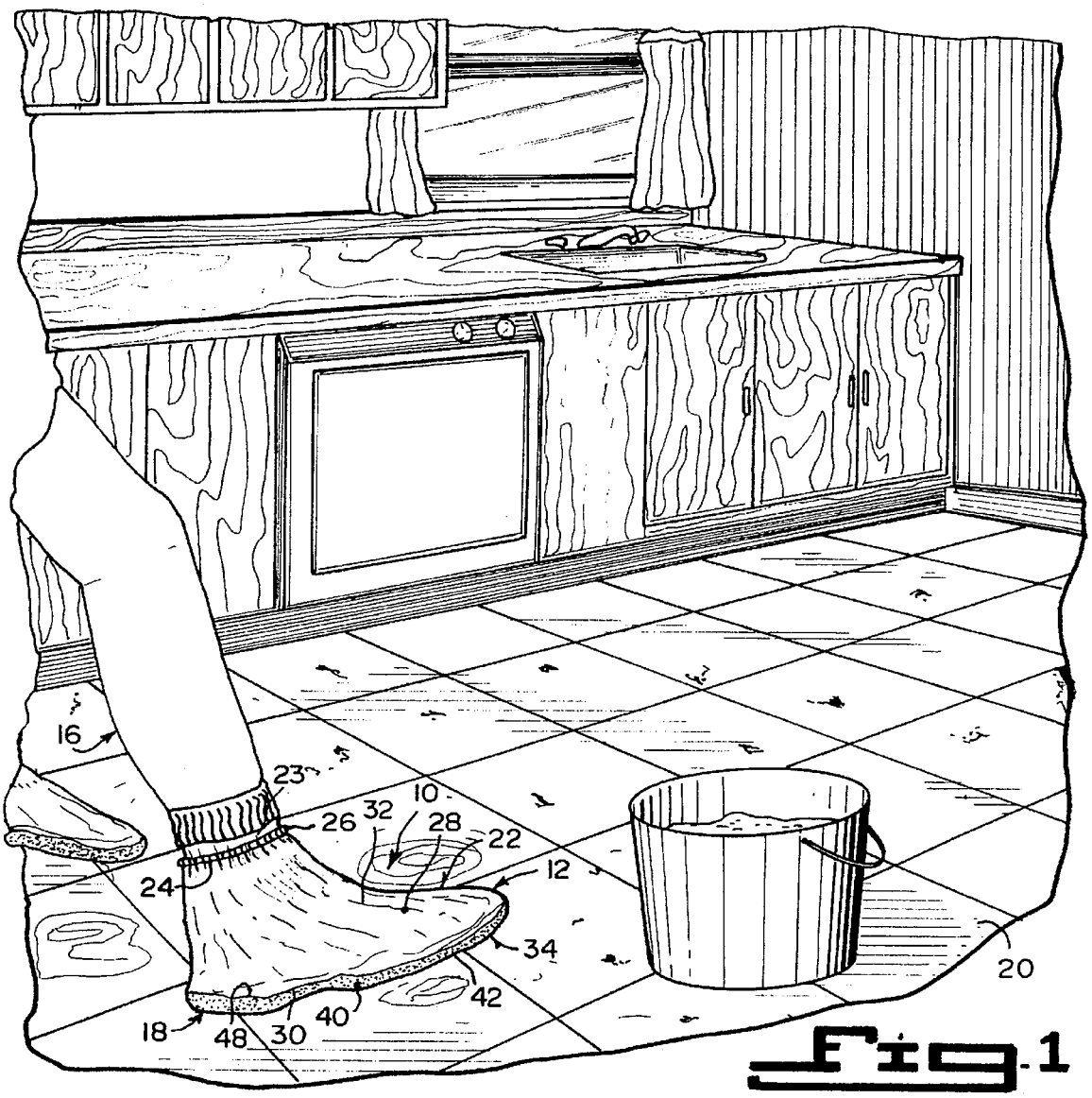
FIG. 1 is a rear perspective view, showing the instant invention used in cleaning a floor.
Figure 2:
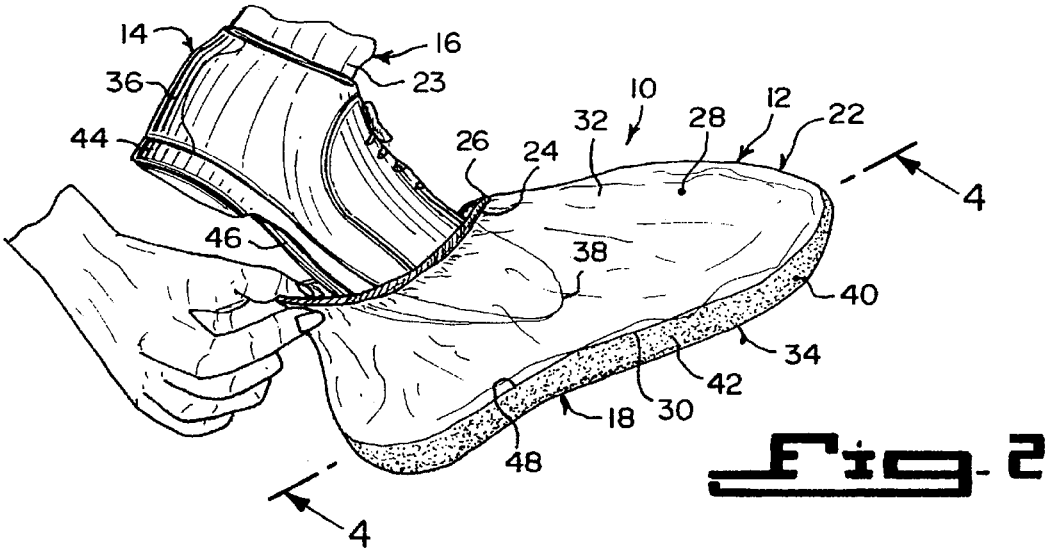
FIG. 2 is a rear perspective view, showing a shoe being inserted into the instant invention.
Figure 3:
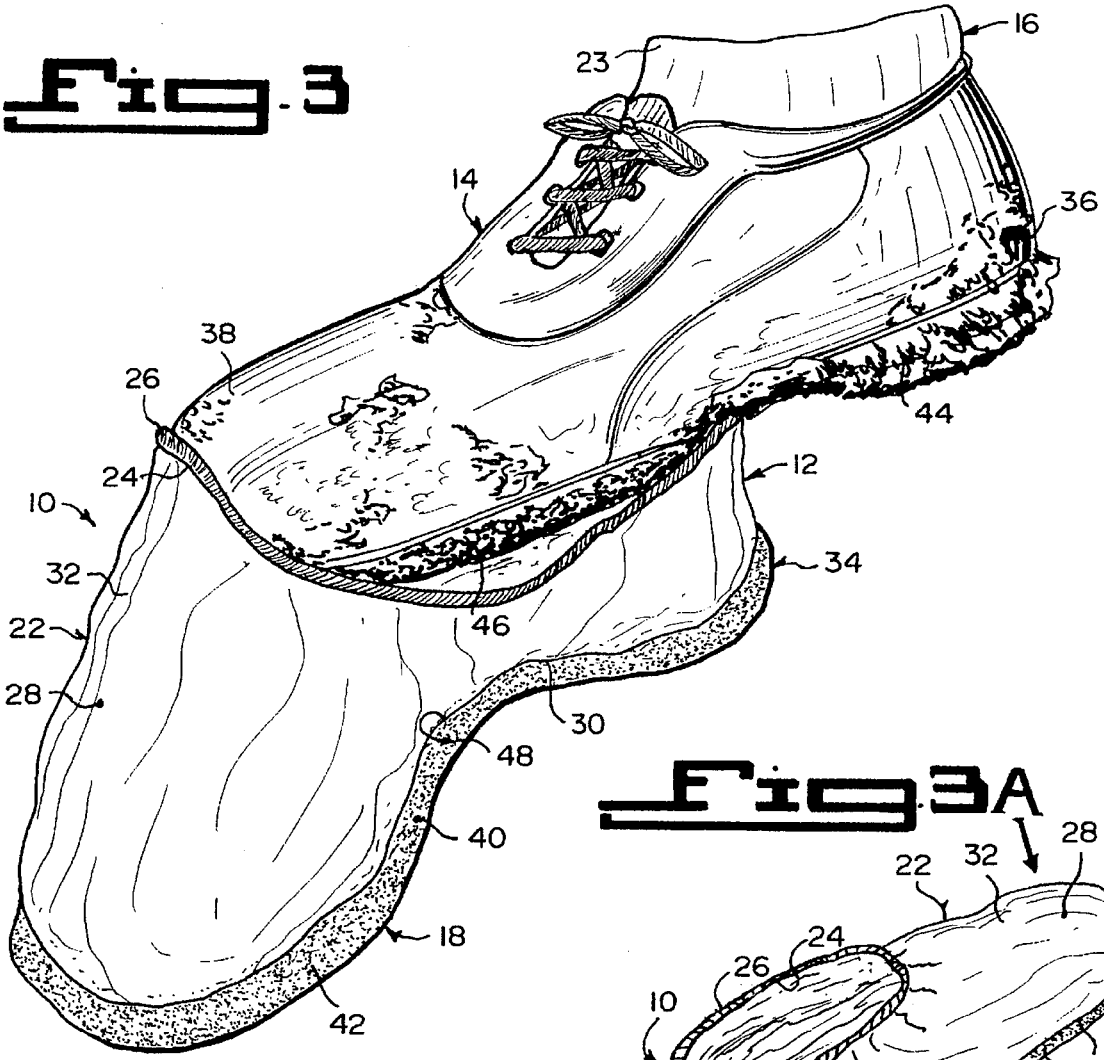
FIG. 3 is a front perspective view, showing a soiled shoe ready to be inserted into the instant invention.
Figure 3A:
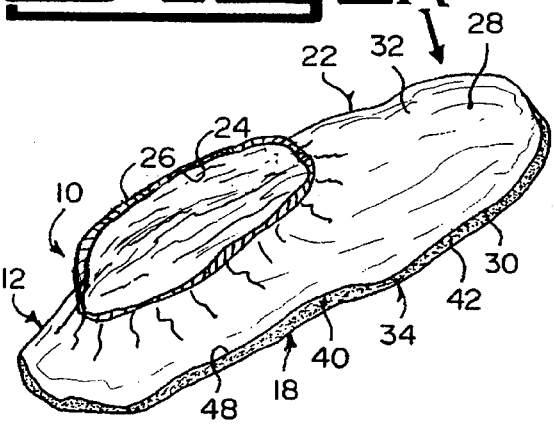
FIG. 3A is a rear perspective view of the instant invention per se.
Figure 4:
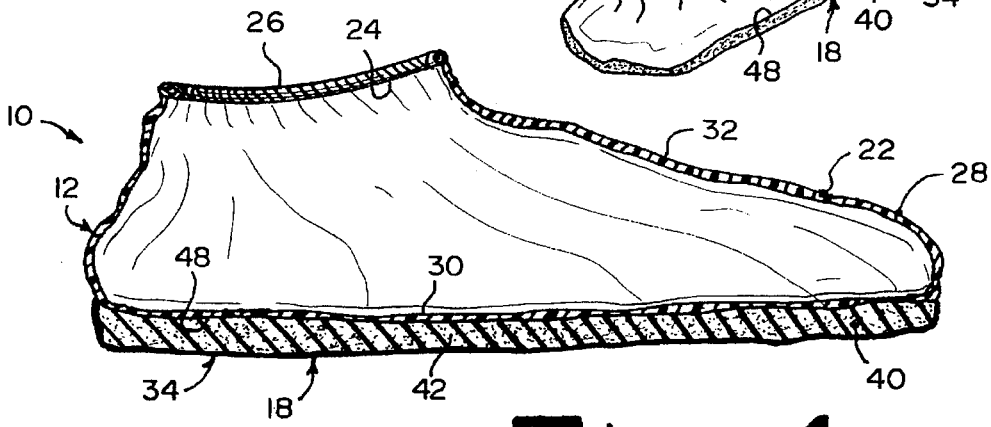
FIG. 4 is a cross sectional view taken along line 4—4 in FIG. 2.

Turning now descriptively to the drawings, in which similar reference characters denote similar elements throughout the several views, FIGS. 1 through 4 illustrate a disposable overshoe mop 10, comprising a structure 12 for covering a shoe 14 or foot worn by a person 16, so as to protect the shoe 14 or foot from water and dirt. A component 18 is affixed to the bottom of the covering structure 12, for cleaning a floor 20.

The covering structure 12 is a stretchable waterproof sheath 22 that snugly fits about the shoe 14 or foot to an ankle 23 of the person 16. The covering structure 12 further has an entrance aperture 24 for the shoe 14 or foot to be inserted therethrough.

An elastic band 26 is secured about the entrance aperture 24 on the covering structure 12, so as to seal off the entrance aperture 24 and better retain the covering structure 12 to the shoe 14 or foot. The covering structure 12 is fabricated out of a thin flexible waterproof plastic material 28. The covering structure 12 contains a bottom wall 30 and an upper wall 32, integral with the bottom wall 30 being generally shaped to fit about the shoe 14 or foot.

The cleaning component 18 is a soft sole 34, extending along a complete length of the bottom wall 30 of the covering structure 12, between a counter 36 and toe 38 of the shoe 14. The soft sole 34 will clean the floor 20 without leaving marks or prints upon the floor. The cleaning component 18 is made out of a compressible water absorbent material 40. Any water deposited upon the floor 20 can be sucked up into the cleaning component 18, thereby preventing slippage upon the floor 20.

The cleaning component 18 can also be an optional foam rubber pad 42, shaped to cover a heel 44 and sole 46 of the shoe 14 or foot. A strong bonding adhesive material 48 is applied between a bottom surface of the covering structure 12 and a top surface of the cleaning component 18, so as to permanently retain the cleaning component 18 to the covering structure 12.

OPERATION OF THE INVENTION

To use the disposable overshoe mop 10, the following steps should be taken:

1. Insert the right shoe 14 or right foot into a first covering structure 12.

2. Make sure that the respective stretchable waterproof sheath 22 and the elastic band 26 are properly positioned on the right shoe 14 or right foot.

3. Insert the left shoe 14 or left foot into a second covering structure 12.

4. Make sure that the respective stretchable waterproof sheath 22 and the elastic band 26 are also properly positioned on the left shoe 14 or left foot.

5. Wash the floor 20 with soapy water.

6. Mop the floor 20 with both of the cleaning components 18, to soak up the soapy water and dry the floor 20.

VARIOUS USES OF THE DISPOSABLE OVERSHOE MOP 10

1. It has the ability to clean the floor 20 without leaving marks or prints upon the newly mopped floor.

2. Help dry the floor 20 and is waterproof, thereby keeping your shoe 14 or foot dry.

3. It prevents slipping on the floor 20.

4. It allows access for others to walk upon a wet floor 20 without soiling the clean floor.

5. You can paint a room without dirtying your shoes 14 or feet.

6. A service/repair person can use them coming into your home, so they will not dirty the floor 20 or carpet.

7. It is an all purpose item to be used on wet or dry floors 20.

8. It can be placed over a soiled shoe 14, to prevent the soiled shoe from depositing dirt upon the floor 20.

9. It is a disposable item. Once used it can be thrown away.

10. By using one on each of both shoes 14, they will tend to clean and mop the floor 20 faster.

LIST OF REFERENCE NUMBERS

10 disposable overshoe mop
12 covering structure of 10
14 shoe
16 person
18 cleaning component of 10
20 floor
22 stretchable waterproof sheath for 12
23 ankle of 16
24 entrance aperture in 12
26 elastic band on 24
28 thin flexible waterproof plastic material for 12
30 bottom wall of 12
32 upper wall of 12
34 soft sole of 18
36 counter of 14
38 toe of 14
40 compressible water absorbent material for 18
42 optional foam rubber pad of 18
44 heel of 14
46 sole of 14
48 strong bonding adhesive material between 12 and 18

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A disposable overshoe mop comprising:

a) means in combination with and for covering a shoe being worn by a person to protect said shoe from water and dirt comprising a stretchable sheath of thin flexible waterproof plastic material snugly fitting and completely covering said shoe to the ankle of said person, said sheath having an entrance aperture for said shoe to be inserted therethrough, an elastic band secured about said entrance aperture to seal off said aperture when said shoe is within said sheath, and a bottom wall continuous and integral With side walls covering the length and width of the bottom of said sheath; and b) means affixed to the bottom wall of said covering means for cleaning a floor comprising a soft sole extending along a complete length of said bottom wall, said soft sole being made out of a compressible water absorbent material covering the entire bottom of said overshoe mop for sucking up any water on said floor and permanently bonded by adhesive to said bottom wall.

* * * * *